US008025125B2

(12) United States Patent
Vetesnik et al.

(10) Patent No.: US 8,025,125 B2
(45) Date of Patent: Sep. 27, 2011

(54) ANCHOR ASSEMBLY

(75) Inventors: Jan Vetesnik, Winnipeg (CA); Garry Ernest John Hamilton, Rosenort (CA)

(73) Assignee: D B Industries, Inc., Red Wing, MN (US)

( * ) Notice: Subject to any disclaimer, the term of this patent is extended or adjusted under 35 U.S.C. 154(b) by 881 days.

(21) Appl. No.: 11/928,252

(22) Filed: Oct. 30, 2007

(65) Prior Publication Data

US 2008/0277557 A1 Nov. 13, 2008

Related U.S. Application Data

(60) Provisional application No. 60/856,608, filed on Nov. 3, 2006.

(51) Int. Cl.
*A62B 35/00* (2006.01)

(52) U.S. Cl. ..... 182/45; 182/3; 248/499

(58) Field of Classification Search ..... 182/3, 45; 248/499

See application file for complete search history.

(56) References Cited

U.S. PATENT DOCUMENTS

| | | | | |
|---|---|---|---|---|
| 2,684,822 | A * | 7/1954 | Odin | 248/179.1 |
| 3,732,842 | A * | 5/1973 | Vara, Sr. | 116/63 P |
| 4,852,692 | A | 8/1989 | Flaherty | |
| 6,715,238 | B2 * | 4/2004 | Zambelli et al. | 52/24 |
| 7,104,371 | B2 * | 9/2006 | Renton | 188/371 |
| 2004/0050620 | A1 | 3/2004 | Luke et al. | |
| 2004/0256176 | A1 | 12/2004 | Argoud | |
| 2005/0269154 | A1 * | 12/2005 | Siemienowicz | 182/3 |
| 2006/0272892 | A1 * | 12/2006 | Poldmaa | 182/36 |
| 2007/0144830 | A1 * | 6/2007 | Mastenbroek | 182/3 |

OTHER PUBLICATIONS

"Skymast", from *Guardian Fall Performance Safety Gear Catalog—2007/08,* 3 pages (Product known of prior to Nov. 2006).

* cited by examiner

*Primary Examiner* — Alvin Chin Shue
(74) *Attorney, Agent, or Firm* — IPLM Group, P.A.

(57) ABSTRACT

An anchor assembly includes a base to which at least one connector and three legs are operatively connected. The connector provides an anchorage point for connection to a lifeline. The legs are secured to a support structure. The legs are reinforced proximate the base and when a force is exerted on the at least one connector by the lifeline, the legs bend proximate the support structure thus placing a shear load on the legs proximate the support structure.

18 Claims, 9 Drawing Sheets

ANCHOR ASSEMBLY

This application claims the benefit of U.S. Provisional Patent Application Ser. No. 60/856,608, filed Nov. 3, 2006.

FIELD OF THE INVENTION

The present invention relates to an anchor assembly for anchoring fall protection and fall arrest safety apparatus to a support structure.

BACKGROUND OF THE INVENTION

Various occupations place people in precarious positions at relatively dangerous heights, thereby creating a need for fall protection and fall arrest safety apparatus. Among other things, such apparatus may include a lifeline operatively connected to an anchorage member secured to a support structure, and a person working in proximity to the anchorage member is operatively connected to the lifeline. Obviously, the lifeline and the anchorage member must be secure enough to provide fall protection for workers during movement proximate the anchorage member. However, this may be more difficult when workers are performing tasks such as building construction because the anchorage members are often difficult to secure and may interfere with the workers' tasks.

The present invention addresses the problems associated with the prior art devices and provides for an anchor assembly for anchoring fall protection and fall arrest safety apparatus to a support structure.

SUMMARY OF THE INVENTION

One aspect of the present invention provides an anchor assembly for connection to a support structure including a base, at least one connector, and at least three legs. The base has a top and a bottom. The at least one connector is connected to the base proximate the top and is configured and arranged for connection to a lifeline. Each of the at least three legs has a first end and a second end. The first ends are connected to the base proximate the bottom and are reinforced proximate the base. The second ends are connectable to the support structure. The legs bend proximate the support structure when a load is exerted on the connector thus positioning the connector proximate the support structure and placing a shear load on the at least three legs proximate the support structure.

Another aspect of the present invention provides an anchor assembly for connection to a support structure including a base, a connector, a leg, and a reinforcement sleeve. The base has at least three mounting members. The connector is connected to the base and is configured and arranged for connection to a lifeline. A leg is connected to each mounting member. Each leg has a first end and a second end. The first end is connected to the base, and the second end is connectable to the support structure. A reinforcement sleeve is connected to each leg proximate the base. Each reinforcement sleeve has a thicker gauge and a larger diameter than the corresponding leg. The legs bend proximate the support structure when a load of at least 200 to 500 pounds is exerted on the connector thus positioning the connector proximate the support structure and placing a shear load on the at least three legs proximate the support structure.

Another aspect of the present invention provides an anchor assembly for connection to a support structure including a base, an extension, a connector, mounting members, legs, and reinforcement sleeves. The base includes a bore, and the extension extends through the bore and is slidably connected to the base. The connector is connected to the extension and is configured and arranged for connection to a lifeline. The mounting members include threaded receptacles and are pivotally connected to the base. The legs include a first end and a second end. The first end is threaded, and the second end is configured and arranged for connection to the support structure. The reinforcement sleeves include threaded bores extending longitudinally therethrough. The first ends of the legs are threaded through respective threaded bores of the reinforcement sleeves and into respective threaded receptacles of the mounting members. The reinforcement sleeves have a thicker gauge and a larger diameter than the legs, and the legs bend proximate the support structure when a load is exerted on the connector thus positioning the connector proximate the support structure and placing a shear load on the legs proximate the support structure.

DETAILED DESCRIPTION OF A PREFERRED EMBODIMENT

Figure 1:
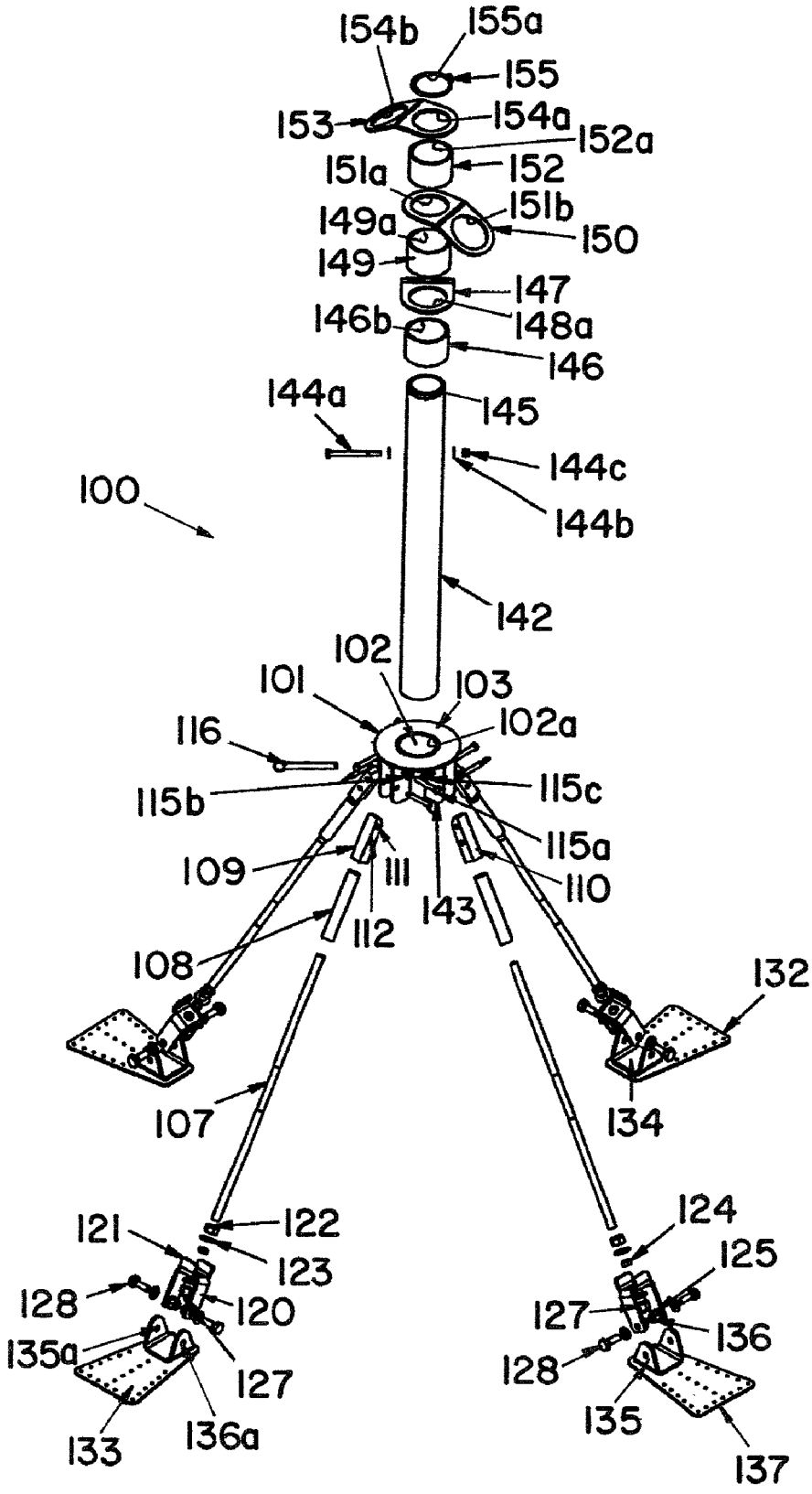
FIG. 1 is an exploded perspective view of an anchor assembly constructed according to the principles of the present invention.
Figure 2:
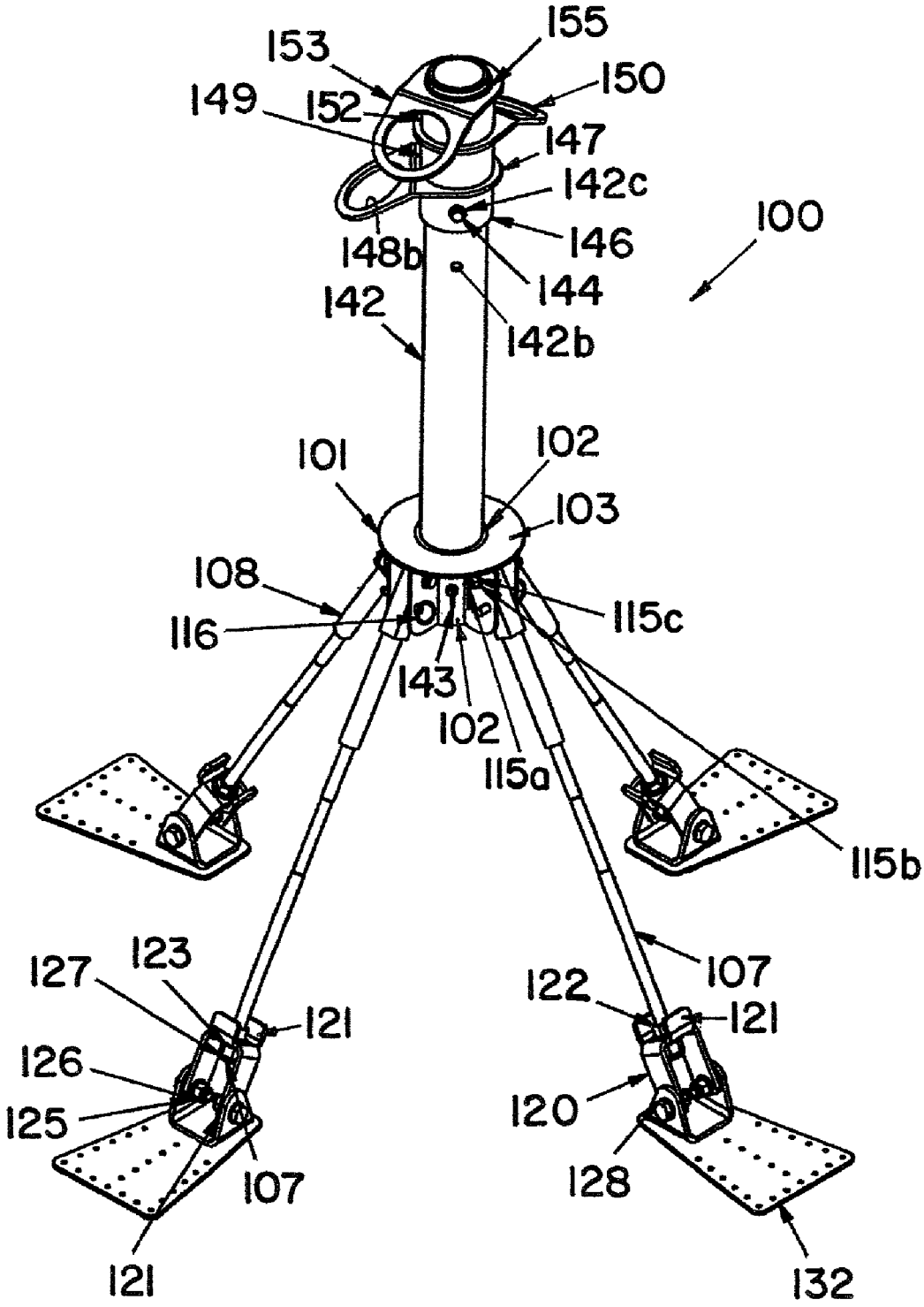
FIG. 2 is a perspective view of the anchor assembly shown in FIG. 1 assembled.

An anchor assembly constructed according to the principles of the present invention is designated by the numeral 100 in the drawings. Another embodiment anchor assembly constructed according to the principles of the present invention is designated by the numeral 100' in the drawings.

The anchor assembly 100 includes a base 101 to which legs 107 and connectors 147, 150, and 153 are operatively connected. Although four legs 107 are shown and described, it is recognized that at least three legs should preferably be used. Further, although three connectors 147, 150, and 153 are shown and described, it is recognized that one or more connectors may be used.

The base 101 includes a cylindrical member 102 having a bore 102*a* extending longitudinally through the cylindrical member 102 and a flange 103 extending outward from the top of the cylindrical member 102. Mounting brackets 104 extend outward from the sides of the cylindrical member 102 and downward from the flange 103 to proximate the bottom of the cylindrical member 102. Preferably, there are two mounting brackets 104 spaced a distance apart approximately ninety degrees from adjacent pairs of mounting brackets 104. Each mounting bracket 104 includes a first aperture 105 proximate the top of the mounting bracket 104 and a second aperture 106 below the first aperture 105 and more proximate the side of the mounting bracket opposite the side attached to the cylindrical member 102. Each pair of mounting brackets 104 corresponds with each leg 107.

The distance between the two mounting brackets 104 proximate each of the four sides of the cylindrical member 102 accommodates a leg mount 109, which interconnects a leg 107 and the corresponding two mounting brackets 104. The leg mount 109 includes a flange 110 having a first aperture 111 proximate the top of the flange 110 and a second aperture 112 below the first aperture 111 and more proximate the side of the flange 110 opposite the side attached to the leg mount 109. The first aperture 111 corresponds with the first aperture 105 of the two mounting brackets 104 and the second aperture 112 corresponds with the second aperture 106 of the two mounting brackets 104. A fastener 115 is inserted through the first apertures 105 and 111 to secure the leg mount 109 to the two mounting brackets 104. The fastener 115 preferably includes a bolt 115*a* inserted through the first aperture 105 of the first mounting bracket 104, through the first aperture 111 of the leg mount 109, and through the first aperture 105 of the second mounting bracket 104. A washer 115*b* is then placed about the end of the bolt 115*a* and then the end of the bolt 115*a* is secured with a lock nut 115*c*. It is recognized that other types of suitable fasteners may be used to secure the leg mount 109 to the mounting brackets 104.

Each of the leg mounts 109 includes a threaded receptacle (not shown) proximate the bottom of the leg mount 109, and each corresponding leg 107 includes a threaded top portion (not shown) that threads into the threaded receptacle of the leg mount 109 to connect the leg 107 to the leg mount 109. Preferably, a reinforcement sleeve 108 includes a threaded bore (not shown) and the threaded top portion of the leg 107 is first threaded through the threaded bore of the reinforcement sleeve 108 before it is threaded into the threaded receptacle of the leg mount 109. The reinforcement sleeve 108 is then tightened against the leg mount 109 to lock the leg 107 and the leg mount 109 together. The reinforcement sleeve 108 reinforces the leg 107 proximate the leg mount 109. The reinforcement sleeves 108 preferably extend downward from the leg mounts 109 approximately one fourth to one third the length from the leg mounts 109 to the end of the legs 107. It is recognized that the length of the reinforcement sleeves 108 depends upon the length and the diameter of the legs 107 and is selected to control the bending loads. The reinforcement sleeves 108 preferably have a larger diameter and have a thicker gauge than the legs 107 so that the legs 107 do not bend proximate the leg mounts 109 and bend more proximate the support structure. The reinforcement sleeves 108 also allow the legs 107 to be thinner, both in diameter and gauge, so that the legs 107 may collapse or bend when subjected to a load should a fall occur. Further, the legs 107 have less weight thus reducing the weight of the anchor assembly 100.

A fastener 116, which is preferably a locking pin, may be inserted through the second apertures 106 and 112 to secure each of the legs 107 in a position for use of the anchor assembly 100. When thus secured, the legs 107 extend outward from the mounting brackets 104 at an angle of approximately thirty degrees to support the base 101. When it is desired to transport or store the anchor assembly, the fasteners 116 may be removed and the legs 107 may be pivoted inward about the fasteners 115. The fasteners 116 may then be inserted through the apertures 112 to secure the legs 107 between the cylindrical member 102 and the fasteners 116.

Figure 4:
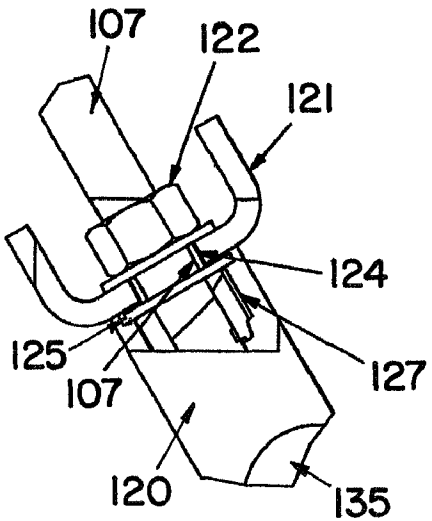
FIG. 4 is a portion of the anchor assembly shown in FIG. 3.
Figure 3:
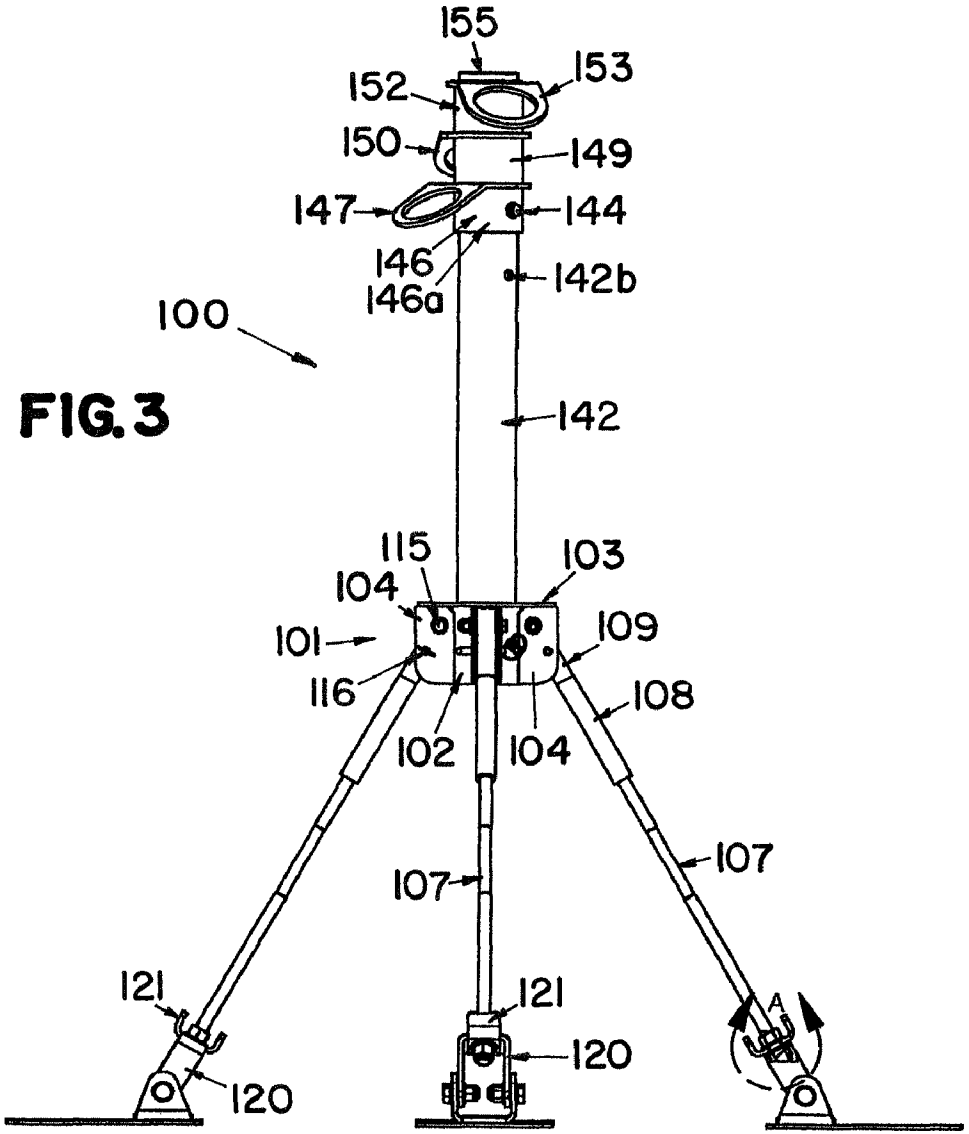
FIG. 3 is a side view of the anchor assembly shown in FIG. 2.

Each of the ends of the legs 107 is preferably threaded and operatively connected to a swivel bracket 120 with upward extending flanges 121, which are preferably used to stiffen the swivel bracket 120. The swivel bracket 120 is preferably an upside down U-shaped bracket with an aperture (not shown) proximate the top of the U-shaped bracket and an aperture (not shown) proximate each of the ends of the U-shaped bracket. The flanges 121 extend upward proximate the top of the U-shaped bracket on opposing sides adjacent the sides from which the ends of the U-shaped bracket extend. As shown in FIG. 4, a hex nut 122 is threaded onto the end of each of the legs 107, a washer 123 is placed proximate each hex nut 122, and a bushing 124 is placed proximate each washer 123. Each of the legs 107 is inserted through the aperture proximate the top of the U-shaped bracket so that the bushing 124 is positioned within the aperture. A washer 125 is placed proximate the U-shaped bracket, and then a lock nut 127 is threaded onto the end of each of the legs 107 thus securing the swivel brackets 120 to the legs 107.

Figure 6:
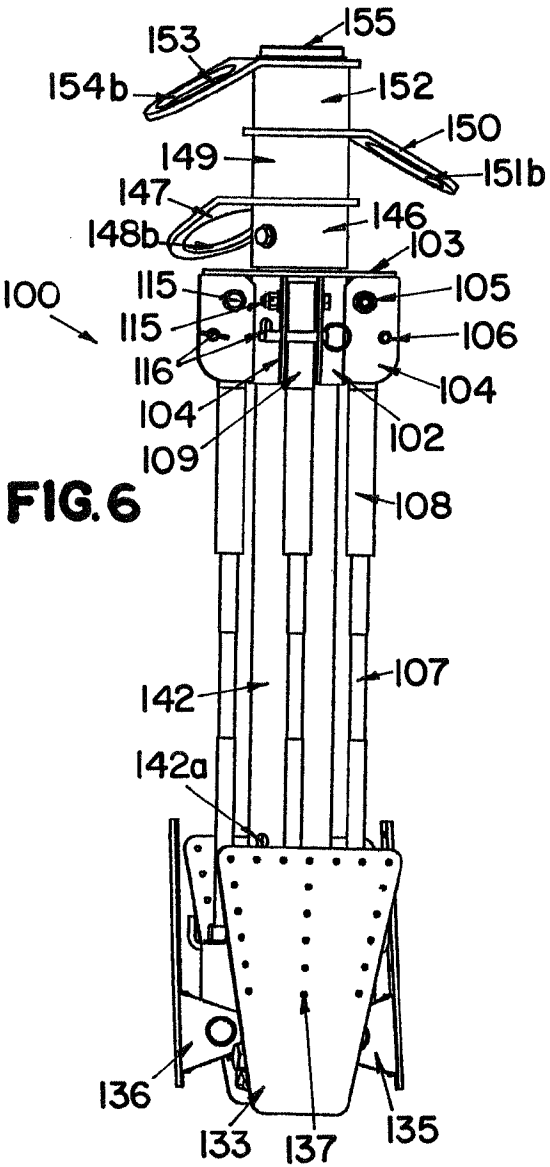
FIG. 6 is a side view of the anchor assembly shown in FIG. 2 in a storage position.
Figure 5:
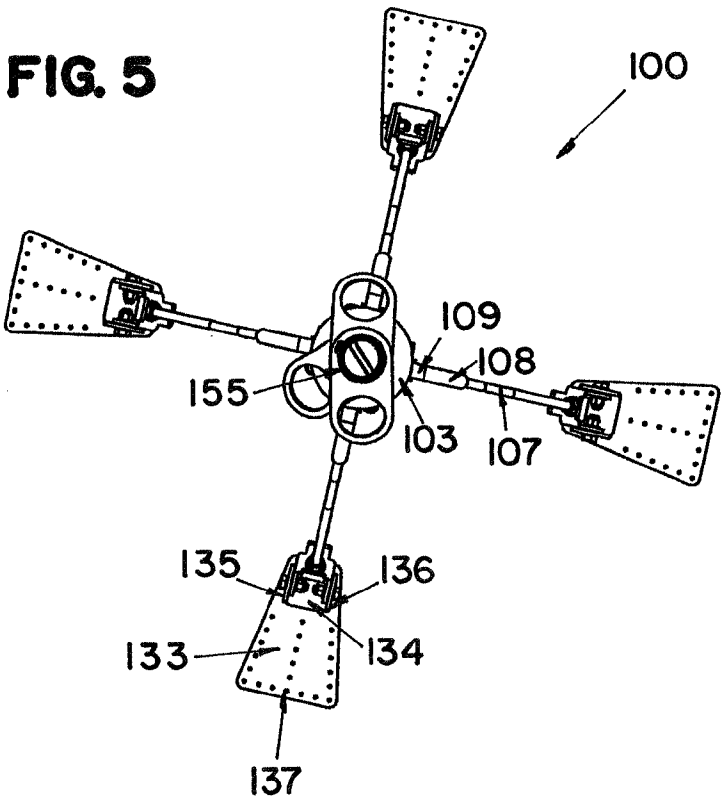
FIG. 5 is a top view of the anchor assembly shown in FIG. 2.

The ends of the U-shaped bracket, the swivel bracket 120, are operatively connected to a foot assembly 132. The foot assembly 132 includes a base 133, which is isosceles trapezoidal-shaped, to which a U-shaped bracket 134 is operatively connected proximate the narrower end of the base 133. The bracket 134 includes a first flange 135 extending upward proximate a rear left side of the base 133 and a second flange 136 extending upward proximate a rear right side of the base 133. The first flange 135 includes an aperture 135*a* and the second flange 136 includes an aperture 136*a*. The base 133 includes a plurality of apertures 137. As shown in FIGS. 5 and 6, the plurality of apertures 137 are proximate the perimeter of the base 133 from the first flange 135, along the adjacent side, along the front, along the opposite adjacent side, and to the second flange 136 and proximate the middle of the base 133 from the front to the bracket 134. The base of the foot assembly could be any suitable shape and could include any suitable number of apertures, including at least one aperture. The foot assembly could be made of any suitable material, including but not limited to, aluminum or steel.

The first flange 135 is operatively connected to the end of the swivel bracket 120 proximate the left side of the leg 107 by aligning the aperture in the end of the swivel bracket 120 with the aperture 135*a* and inserting a fastener 128 therethrough. The second flange 136 is operatively connected to the end of the swivel bracket 120 proximate the right side of the leg 107 by aligning the aperture in the end of the swivel bracket 120 with the aperture 136*a* and inserting a fastener 128 therethrough. Preferably, each fastener 128 includes a bolt, a washer, and a lock nut. Each leg 107 is operatively connected to a swivel bracket 120, which is operatively connected to a foot assembly 132. The swivel bracket 120 allows the foot assembly 132 to be positioned relatively flat against the support structure. At least one fastener (not shown), which is preferably a screw or an anchor member, is inserted through a corresponding number of the plurality of apertures 137 of the base 133 to secure each base 133 to the support structure. The quantity of fasteners depends upon the type and the size of the fastener and the type of support structure. For example, if the support structure is roof trusses, pilot holes may be drilled into the roof trusses so as to not split the roof trusses as the screws are being secured thereto. If the support structure is a concrete structure, a single concrete anchor could be used to secure each base to the concrete structure.

An extension 142 is an elongate cylindrical member configured and arranged to fit within the bore 102*a* of the cylindrical member 102 of the base 101. A first spacer 146 is a cylindrical member including a pair of apertures 146*a* in alignment in opposing sides of the first spacer 146 and a bore 146*b* extending longitudinally through the first spacer 146 through which the top of the extension 142 is inserted. A first connector 147 includes a first opening 148*a* and a second opening 148*b*. The top of the extension 142 is inserted through the first opening 148*a* and the second opening 148*b* provides a first anchorage point. A second spacer 149 is a cylindrical member including a bore 149*a* extending longitudinally through the second spacer 149 through which the top of the extension 142 is inserted. A second connector 150 includes a first opening 151*a* and a second opening 151*b*. The top of the extension 142 is inserted through the first opening 151*a* and the second opening 151*b* provides a second anchorage point. A third spacer 152 is a cylindrical member including a bore 152*a* extending longitudinally through the third spacer 152 through which the top of the extension 142 is inserted. A third connector 153 includes a first opening 154*a* and a second opening 154*b*. The top of the extension 142 is inserted through the first opening 154*a* and the second opening 154*b* provides a third anchorage point. The top of the extension 142 is then inserted through an opening 155*a* in a snap ring 155, and the snap ring 155 is secured to the top of the extension 142.

The extension 142 includes first apertures 142*a* proximate the bottom of the extension 142, second apertures 142*b* proximate below the first spacer 146, and third apertures 142*c* that correspond with the apertures 146*a* in the first spacer 146. The apertures 142*a*, 142*b*, and 142*c* are each a pair of apertures in alignment in opposing sides of the extension 142. A fastener 144 is used to secure the first spacer 146 to the extension 142. Preferably, a bolt 144*a* is inserted through the corresponding apertures 142*c* and 146*a*, a washer 144*b* is placed proximate the end of the bolt 144*a* and the side of the extension 142, and then the end of the bolt 144*a* is secured with a lock nut 144*c*. The first spacer 146 is secured to the extension 142 with the fastener 144 and the snap ring 155 is secured to the top of the extension 142. The top of the extension 142 includes a groove 145 machined into the outer diameter of the extension 142, and the snap ring 155 fits into the groove 145. Thus, the connectors 147, 150, and 153 and the spacers 149 and 152 are secured between the first spacer 146 and the snap ring 155 proximate the top of the extension 142.

A fastener 143, which is preferably a locking pin, is inserted through the apertures 142*a* and the corresponding apertures (not shown) in the cylindrical member 102 to secure the extension 142 to the base 101 in a use position. When it is desired to transport or to store the anchor assembly 100, the fastener 143 may be removed and the extension 142 slid downward so that the apertures 142*b* align with the corresponding apertures (not shown) in the cylindrical member 102 and the fastener 143 inserted therethrough to secure the extension 142 to the base 101 in a storage position. Further, the fasteners 116 may be removed and the legs 107 may be pivoted inward about the fasteners 115. The fasteners 116 may then be inserted through the apertures 112 in the leg mount 109 to secure the legs 107 between the cylindrical member 102 and the fasteners 116 in a storage position. The storage position is shown in FIG. 6. This compact configuration allows the anchor assembly 100 to be easily transported and stored.

Figure 10:
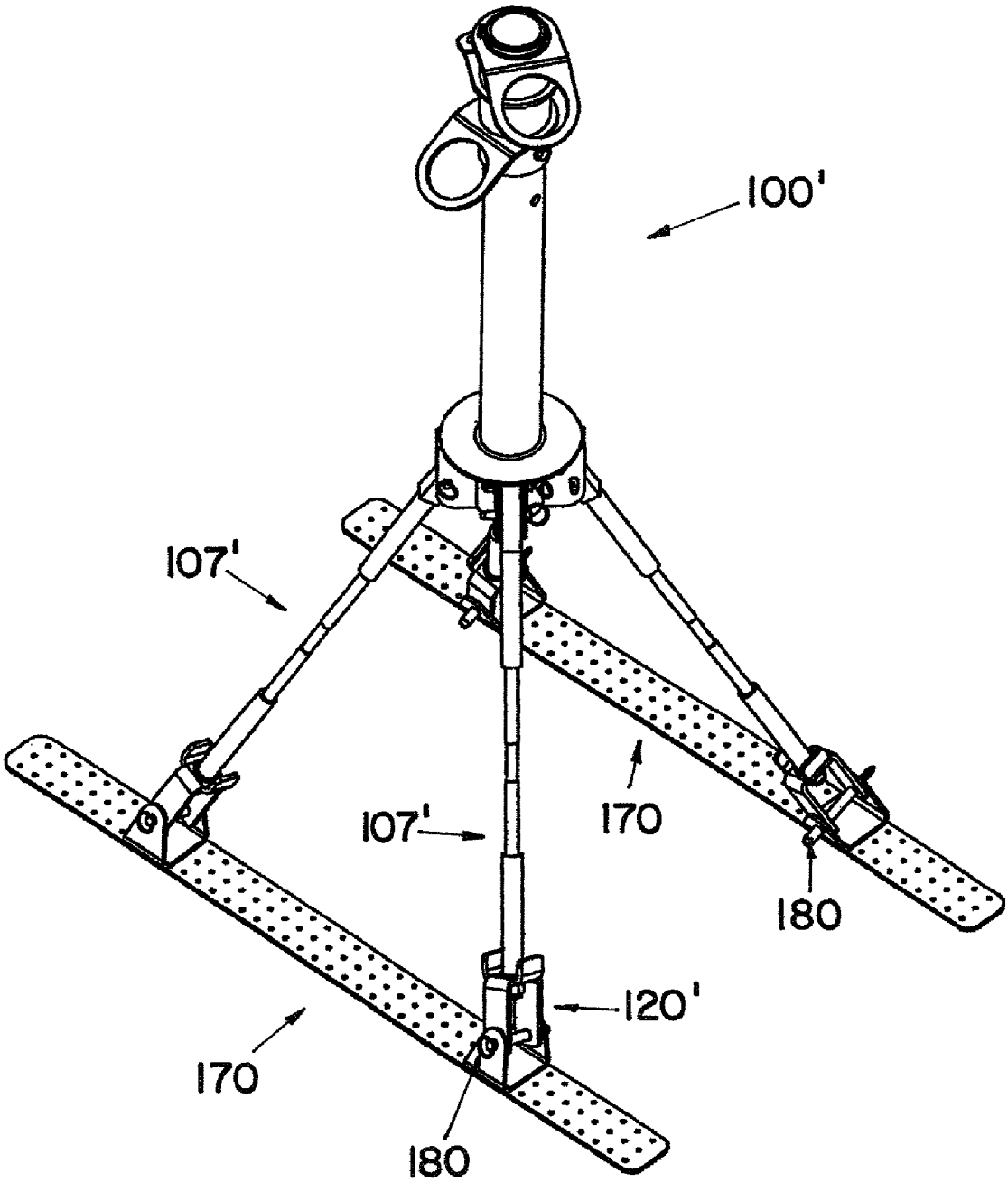
FIG. 10 is a perspective view of another embodiment anchor assembly constructed according to the principles of the present invention.
Figure 11:
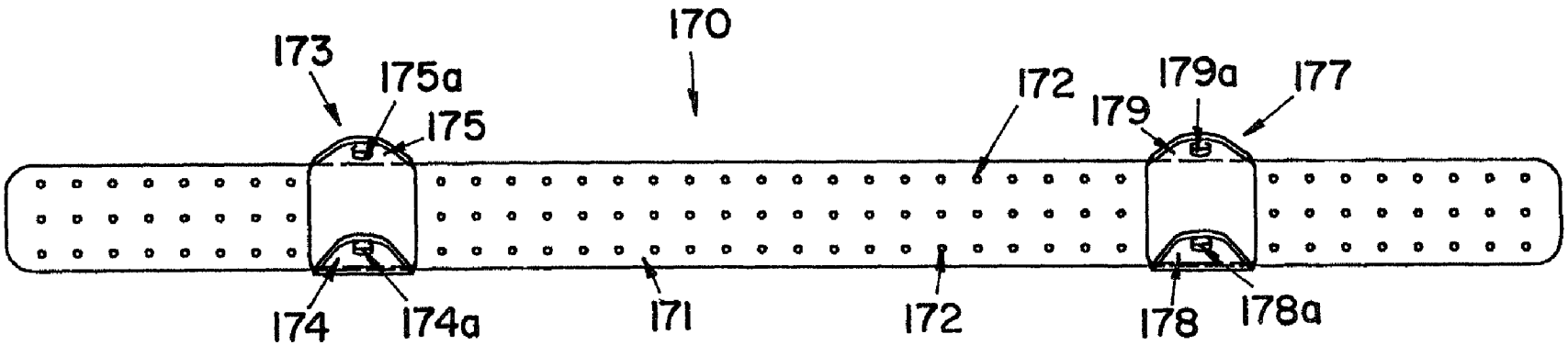
FIG. 11 is a perspective view of a rail assembly for use with the anchor assembly shown in FIG. 10.

The anchor assembly 100' is substantially identical to the anchor assembly 100 except the corresponding swivel bracket 120' is operatively connected to a rail assembly 170 rather than to the foot assembly 132 as shown in FIG. 10. The rail assembly 170 includes an elongate base 171 including a plurality of apertures 172. Preferably, the plurality of apertures 172 forms three rows, a first row proximate one side, a second row proximate the middle, and a third row proximate the other side. A first U-shaped bracket 173 and a second U-shaped bracket 177 are operatively connected to the base 171 and spaced a distance apart so that the brackets 173 and 177 may be operatively connected to adjacent legs 107'. As shown in FIG. 11, the first U-shaped bracket 173 includes a first flange 174 with an aperture 174*a* extending upward proximate one side of the base 171 and a second flange 175 with an aperture 175*a* extending upward proximate the other side of the base 171. The second U-shaped bracket 177 includes a first flange 178 with an aperture 178*a* extending upward proximate one side of the base 171 and a second flange 179 with an aperture 179*a* extending upward proximate the other side of the base 171.

The rail assembly 170 is positioned so that two adjacent legs 107' may be secured thereto, and a second rail assembly 170 is positioned substantially parallel to the other rail assembly 170 so that the remaining two adjacent legs 107' may be secured thereto. Similar to how the foot assemblies 132 are connected to the swivel brackets 120 of the anchor assembly 100, the apertures 174*a* and 175*a* of the first U-shaped bracket 173 and the corresponding apertures of the swivel bracket 120' are aligned and then fasteners 180 are inserted therethrough to secure one of the legs 107' to the bracket 173. The apertures 178*a* and 179*a* of the second U-shaped bracket 177 and the corresponding apertures of the swivel bracket 120' are aligned and then fasteners 180 are inserted therethrough to secure the other leg 107' to the bracket 177. The remaining two adjacent legs 107' are similarly secured to the second rail assembly 170.

The anchor assemblies 100 and 100' provide elevated anchorage points, which help prevent the lifelines from dragging on the support structures thus reducing the wear on the lifelines and reducing the opportunities for the lifelines to get caught on objects either on the support structures or objects operatively connected to the support structures. The support structures could include many types of surfaces such as, but not limited to, roof trusses, flat roof structures, concrete surfaces, and steel surfaces. Preferably, up to three workers could connect lifelines to the anchor assemblies 100 and 100'.

Figure 7:
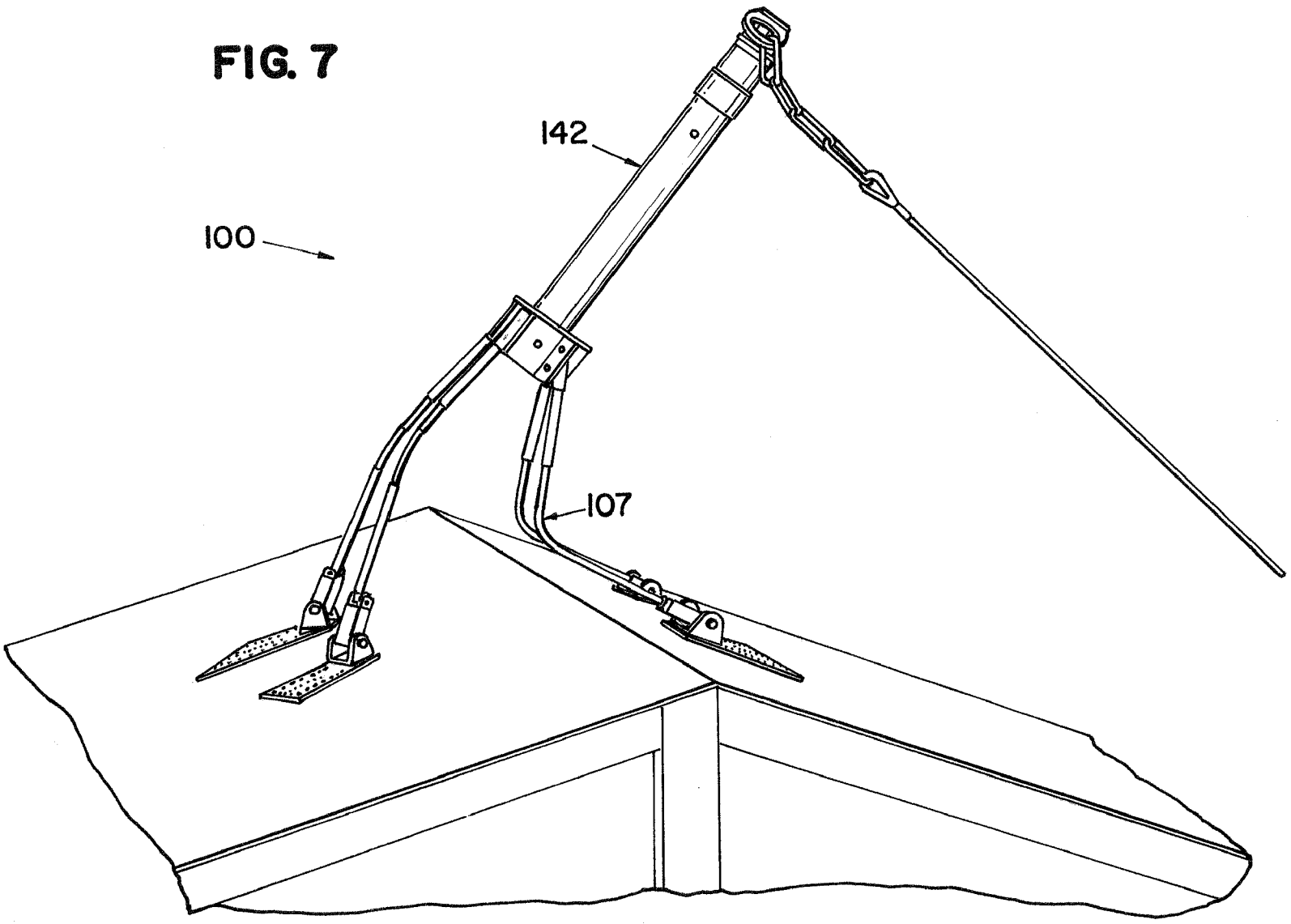
FIG. 7 is a side perspective view showing an anchor assembly constructed according to the principles of the present invention being subjected to the forces of a load.
Figure 8:
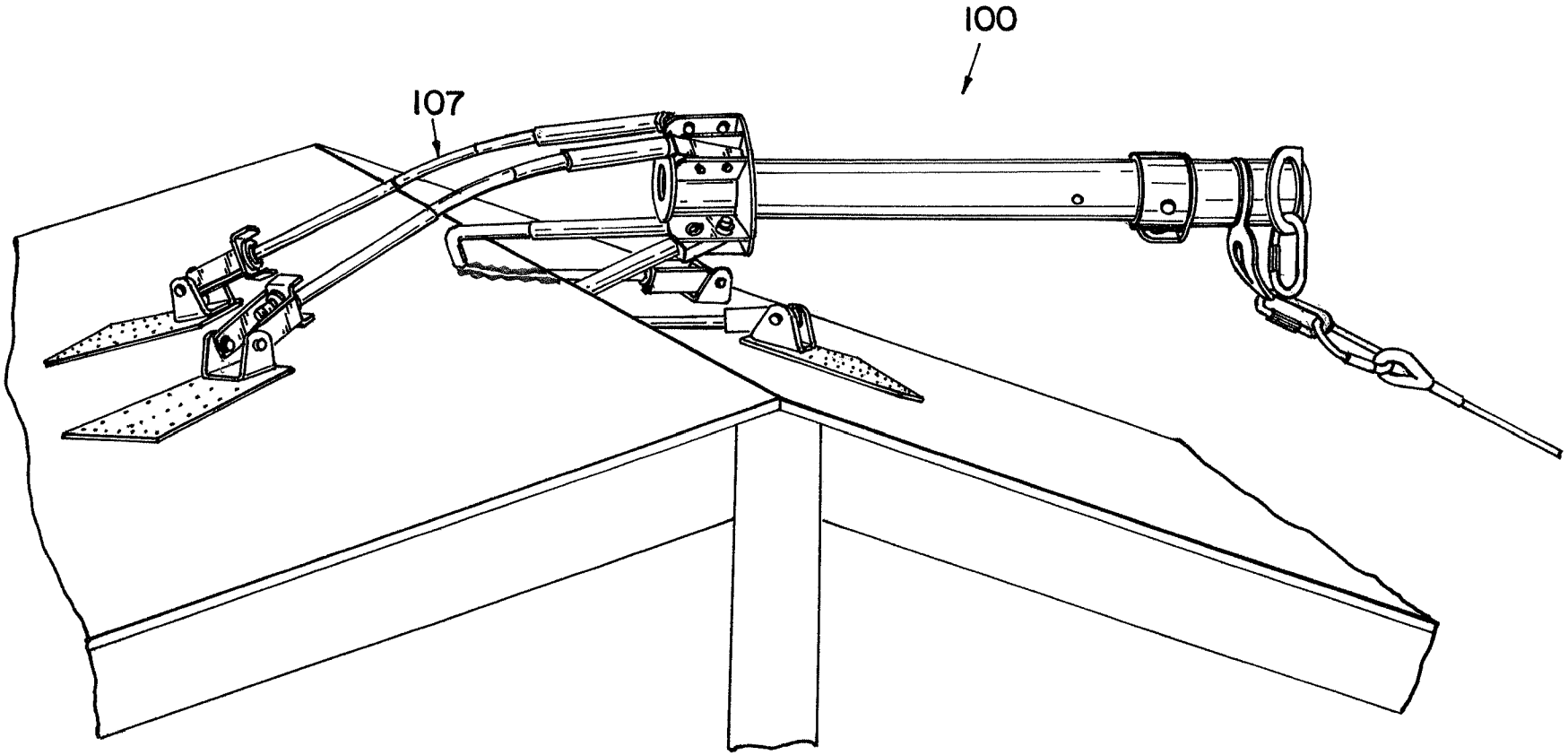
FIG. 8 is a side perspective view of the anchor assembly shown in FIG. 7 after it has been subjected to the forces of the load.
Figure 9:
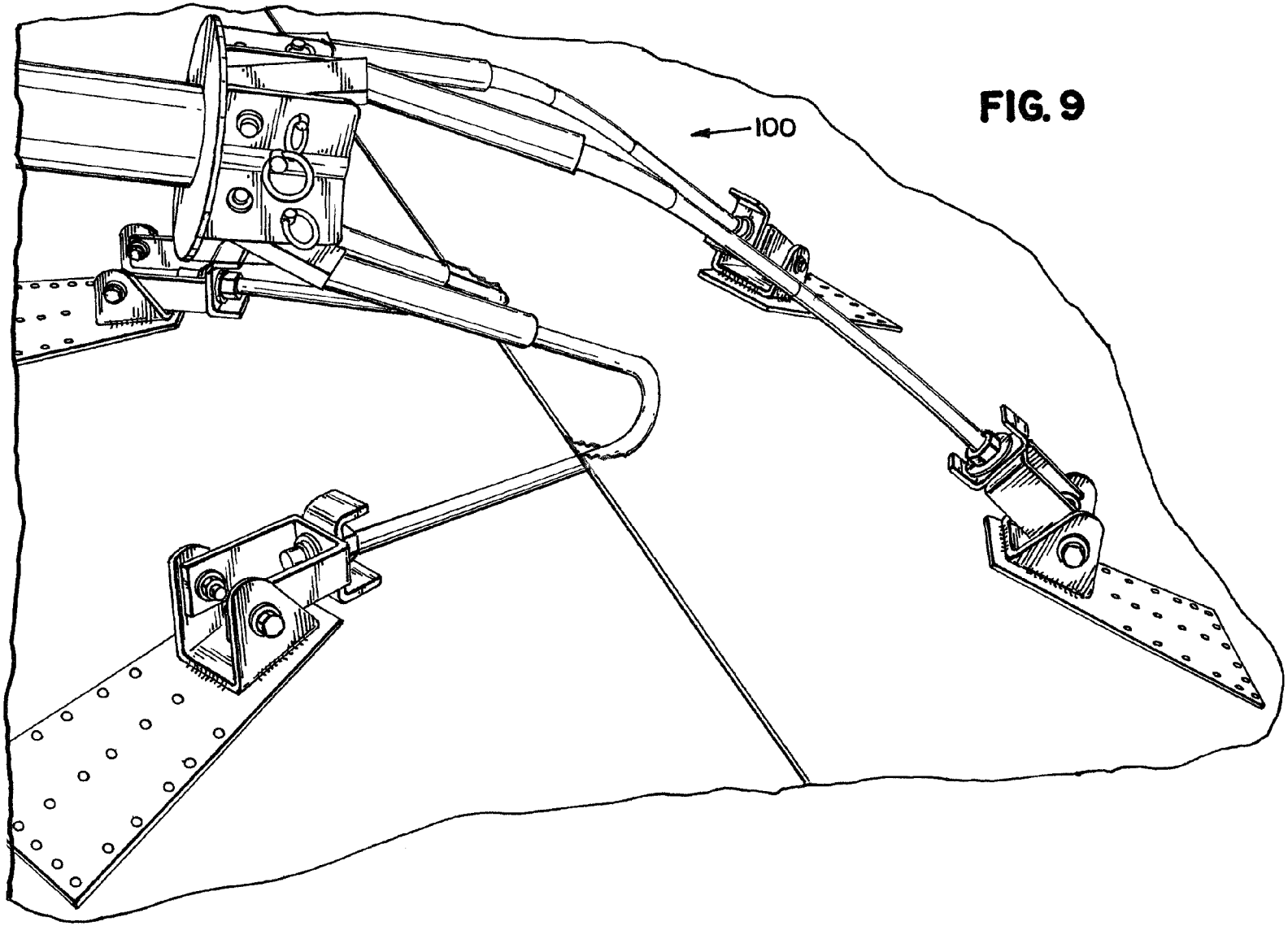
FIG. 9 is a side perspective view of the anchor assembly shown in FIG. 8 one hundred eighty degrees from the side shown in FIG. 8 after the anchor assembly has been subjected to the forces of the load.

The anchor assemblies 100 and 100' are able to withstand loads tip to 5400 pounds when secured to a support structure such as roof trusses. It is recognized that this limit could vary depending upon the support structure. Should a fall occur, the lifeline pulls on the connector to which it is connected (connector 147, 150, or 153), and the legs 107 collapse so that the connector, the extension 142, and the base 101 are proximate the support structure, which reduces the likelihood that the anchor assemblies 100 and 100' will detach from the support structure. Preferably, the legs 107 will begin to bend when subjected to loads of approximately 200 to 500 pounds. FIG. 7 shows an anchor assembly being subjected to the forces of a load, and FIGS. 8 and 9 show the anchor assembly after it has been subjected to the forces of the load. The anchor assembly has broken through the plywood connected to the roof trusses. Because the legs 107 collapse, the connectors 147, 150, and 153 are pulled downward in the direction the lifeline pulls on the connector to which it is connected so the load is exerted on the fasteners securing the anchor assembly to the support structure as a shear load. In addition, the collapsing legs 107 absorb energy from the force of the fall. The fasteners may be positioned through the plurality of apertures 137 on the foot assemblies 132 and the fasteners may be positioned through the plurality of apertures 172 on the rail assemblies 170 to assist in distributing the load. Because the foot assembly 132 includes a base 133 that is isosceles trapezoidal-shaped, the fasteners are positioned offset relative to the legs 107 thus also assisting in exerting the load on the fasteners as a shear load.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An anchor assembly for connection to a support structure, comprising:

a base having a top and a bottom;

at least one connector connected to the base proximate the top and configured and arranged for connection to a lifeline;

at least three legs each having a first end and a second end, the first ends connected to the base proximate the bottom and being reinforced proximate the base, the second ends being connectable to the support structure, wherein the legs bend proximate the support structure when a load is exerted on the connector thus positioning the connector proximate the support structure and placing a shear load on the at least three legs proximate the support structure;

a reinforcement sleeve for each leg to provide reinforcement for each leg, each reinforcement sleeve having a threaded bore that extends through a length of the reinforcement sleeve;

a mounting member for each leg, each mounting member being coupled proximate the bottom of the base, each mounting member including a threaded receptacle; and the first end of each leg having threads, the threads of the first end of each leg being threaded through a respective threaded bore of an associated reinforcement sleeve and into a respective threaded receptacle of an associated mounting member to connect the leg to the base.

2. The anchor assembly of claim 1, further comprising an extension connected to the base and extending upward from the base, wherein the at least one connector is connected to the extension.

3. The anchor assembly of claim 2, wherein the extension is slidable downward through a bore in the base and the at least three legs are pivotable inward to position the anchor assembly in a storage position.

4. The anchor assembly of claim 1, wherein each of the at least three legs has a length and each reinforcement sleeve extends downward approximately one fourth to one third the length.

5. The anchor assembly of claim 1, wherein the reinforcement sleeves have a thicker gauge and a larger diameter than the legs.

6. The anchor assembly of claim 1, wherein each of the at least three legs includes a swivel bracket proximate the second end to which a foot assembly is connected.

7. The anchor assembly of claim 1, wherein four legs are connected to the base and each of the four legs includes a swivel bracket proximate the second end, a first rail assembly being connected to a first two adjacent legs and a second rail assembly being connected to a second two adjacent legs.

8. The anchor assembly of claim 1, wherein the load is at least 200 to 500 pounds.

9. The anchor assembly of claim 1, wherein the load is up to 5400 pounds.

10. An anchor assembly for connection to a support structure, comprising:

a base having at least three mounting members;

a connector connected to the base, the connector being configured and arranged for connection to a lifeline;

a leg connected to each mounting member, each leg having a first end and a second end, the first end being connected to the base, the second end being connectable to the support structure;

a reinforcement sleeve connected to each leg proximate the base, the reinforcement sleeves having a thicker gauge and a larger diameter than the legs;

the at least three mounting members having threaded receptacles, the reinforcement sleeves having threaded bores, and the legs having threaded top portions, wherein the top portions of the legs are threaded through respective threaded bores of the reinforcement sleeves and into respective threaded receptacles of the mounting members; and wherein the legs bend proximate the support structure when a load of at least 200 to 500 pounds is exerted on the connector thus positioning the connector proximate the support structure and placing a shear load on the at least three legs proximate the support structure.

11. The anchor assembly of claim 10, further comprising an extension connected to the base, the connector being connected to the extension, wherein the extension is slidable downward through a bore in the base and the legs are pivotable inward to position the anchor assembly in a storage position.

12. The anchor assembly of claim 10, wherein each of the legs has a length and each of the reinforcement sleeves extends downward approximately one fourth to one third the length.

13. The anchor assembly of claim 10, wherein the load is up to 5400 pounds.

14. An anchor assembly for connection to a support structure, comprising:

a base including a bore;

an extension extending through the bore and being slidably connected to the base;

a connector connected to the extension, the connector configured and arranged for connection to a lifeline;

mounting members including threaded receptacles and being pivotally connected to the base;

legs including a first end and a second end, the first end being threaded, the second end configured and arranged for connection to the support structure;

reinforcement sleeves including threaded bores extending longitudinally therethrough; and wherein the first ends of the legs are threaded through respective threaded bores of the reinforcement sleeves and into respective threaded receptacles of the mounting members, the reinforcement sleeves having a thicker gauge and a larger diameter than the legs, the legs bending proximate the support structure when a load is exerted on the connector thus positioning the connector proximate the support structure and placing a shear load on the legs proximate the support structure.

15. The anchor assembly of claim 14, wherein the mounting members are at least three mounting members, the legs are at least three legs, and the reinforcement sleeves are at least three reinforcement sleeves.

16. The anchor assembly of claim 14, wherein the extension is slidable downward through the bore in the base and the legs are pivotable inward to position the anchor assembly in a storage position.

17. The anchor assembly of claim 14, wherein each of the legs has a length and each of the reinforcement sleeves extends downward approximately one fourth to one third the length.

18. The anchor assembly of claim 14, wherein the load is 200 to 500 pounds.

* * * * *